US005127161A

United States Patent [19]

Ikeda

[11] Patent Number: 5,127,161

[45] Date of Patent: Jul. 7, 1992

[54] CUTTER

[75] Inventor: Shunsuke Ikeda, Tokyo, Japan

[73] Assignee: Saiko Inc., Tokyo, Japan

[21] Appl. No.: 719,502

[22] Filed: Jun. 24, 1991

[30] Foreign Application Priority Data

Jun. 22, 1990 [JP] Japan ..... 2-165463
Jun. 14, 1991 [JP] Japan ..... 3-143543

[51] Int. Cl.[5] ..... B26B 29/00
[52] U.S. Cl. ..... 30/294; 30/DIG. 3
[58] Field of Search ..... 30/289, 293, 294, DIG. 3, 30/2

[56] References Cited

U.S. PATENT DOCUMENTS 3,153,853 10/1964 Lipton ..... 30/294
4,711,031 12/1987 Annello ..... 30/DIG. 3

FOREIGN PATENT DOCUMENTS 2226288 11/1974 France ..... 30/DIG. 3
580504 10/1976 Switzerland ..... 30/DIG. 3

*Primary Examiner*—Douglas D. Watts
*Attorney, Agent, or Firm*—Fleit, Jacobson, Cohn, Price, Holman & Stern

[57] ABSTRACT

A cutter is described for cutting through an article, such as an envelope, at a given distance from its edge, approximately straight and parallel to the edge. An edge portion of the article to be cut, such as an envelope, is positioned on a floor, and then it is slid with its edge in contact with a sliding side surface perpendicular to the floor. The thing to be cut is pressed against the sliding surface with a press means when cut and slashed with a blade edge at a given distance from the envelope edge approximately straight and parallel to the edge.

3 Claims, 6 Drawing Sheets

CUTTER

FIELD OF THE INVENTION

This invention relates to a cutter for opening an envelope, for example, at a given distance from its edge approximately straight and parallel to the edge.

DESCRIPTION OF THE PRIOR ART

In order to open an envelope, we conventionally adopt a method of breaking open a fastened flap with a knife, and another method of cutting off the edge portion with a cutter.

The former method, as shown in FIG. 11, is of inserting a knife 1 into a gap in the fastened flap 2*a* of an envelope 2 and breaking open the flap.

The latter method, as shown in FIG. 12, is of cutting off the edge portion at the opening side from an envelope with a letter opener. To describe the latter in detail, the edge portion at the opening side is inserted into a sliding groove 4 of a body 3, and is slid in the right direction in the drawing. After switching on a switch 5 by contact with the envelope, a round blade 6 rotates and cuts off the edge portion, which is carried in the direction of the arrow turning of the blade during the cutting.

However, both the methods have the following drawbacks

The former method cannot be used if there is no gap in the flap 2*a* to insert a knife, and the method is too time consuming. Furthermore, the knife 1 needs care in use and while carrying it about. Instead of the knife 1 mostly made of metal, a plastic or wooden knife, which may be blunter, may produce a fluffy and ugly cut opening.

The latter method, though automatic and convenient, has the following problems.

When the edge is cut off with the round or gear-like blade 6, the envelope remains apart from the sliding surface and unstable owing to the separation of the envelope form the surface of the groove 4. Therefore, it is impossible to cut the envelope at a given distance from the edge. Other problems are those of noise by an electric motor and the large-size of the letter opener.

SUMMARY OF THE INVENTION

An object of the invention is to provide a cutter for cutting through an edge portion of an article to be cut, such as an envelope, always at a given distance from its edge, straight and parallel to the edge.

A cutter of the invention for cutting through the edge portion is characterized by a body, a sliding floor for sliding an edge potion of an article to be cut thereon, a sliding side surface formed approximately perpendicular to the sliding floor for keeping the edge in contact therewith and for sliding thereon, a blade approximately parallel to the sliding side surface disposed on the ceiling surface opposite the sliding floor, and a press means for pressing the article to be cut against the sliding floor when cut.

Furthermore, a cutter of the invention is characterized by an escape means for preventing the article to be cut toward the floor (or in the direction opposite the blade) in proportion to the thickness of the article to be cut.

Furthermore, a cutter of the invention is characterized in that the escape means is a given clearance between the tip of the blade and the sliding surface.

Furthermore, a cutter of the invention is characterized in that plural blades are disposed in series and the tip of the sub blade at the upper or left side in the sliding stream is more distant from the sliding floor than that of the main blade at the down or right side in the sliding stream.

Furthermore, a cutter of the invention is characterized in that the side surface is curved approximately from the part of the side surface opposite the main blade downward.

Furthermore, a cutter of the invention is characterized in that the blades are replacable.

Furthermore, a cutter of the invention is characterized in that the body may be used for other functions beside for a cutter.

Furthermore, a cutter of the invention is characterized in that the blade can be used both for the downward sliding direction and for the upward.

DETAILED DESCRIPTION

Figure 1:
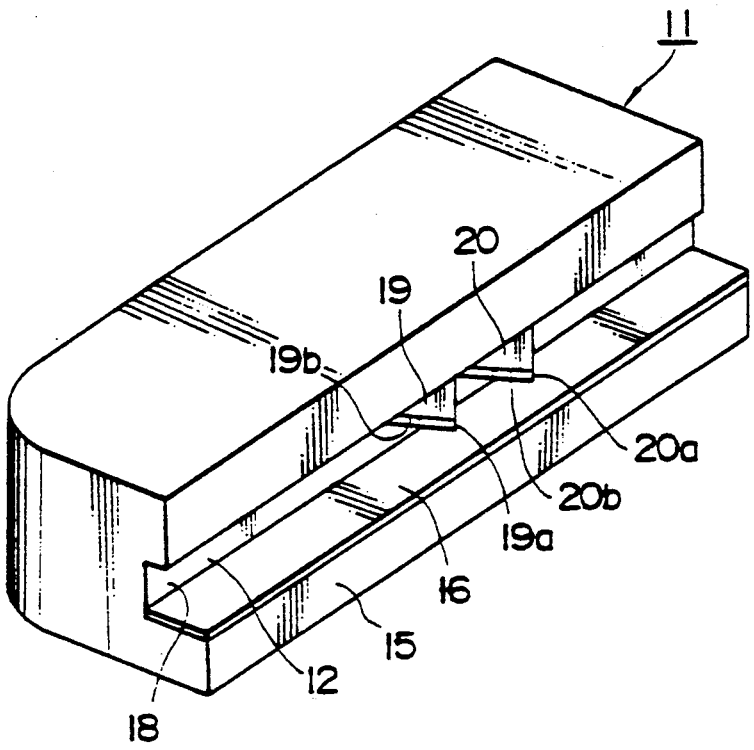
FIG. 1 is a perspective view of a letter opener according to a first embodiment of the invention.

The invention is described in greater detail hereinafter in relation to the attached drawings.

FIG. 1 through FIG. 5 show an embodiment of the application of a cutter to a letter opener.

A letter opener of this embodiment comprises a nearly rectangular resinous body 11, a sliding groove 12 channeled in a side of the body 11. An edge portion 14 at the opening side of an envelope 13 is inserted into the groove 12 and then slid to the right. A sliding floor 15 for receiving and sliding the edge portion 14 of the envelope 13 is formed at a lower part of the groove 12. And also a cushion 16 of predetermined thickness serving as an escape means is attached to the sliding floor 15. A sliding side surface 18 for remaining in contact with and receiving the sliding edge 17 of the envelope 13 is formed at the side wall perpendicular to the sliding floor 15 of the groove 12.

Figure 2:
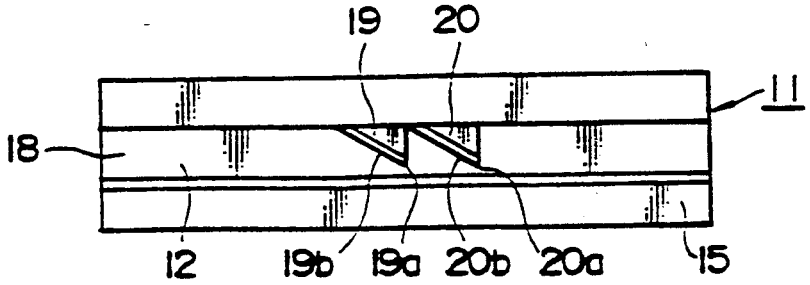
FIG. 2 is a front view of a letter opener according to a first embodiment of the invention.
Figure 3:
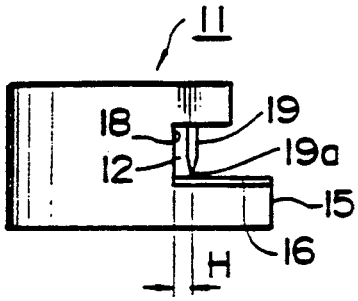
FIG. 3 is a left side view of a letter opener according to a first embodiment of the invention.
Figure 4:
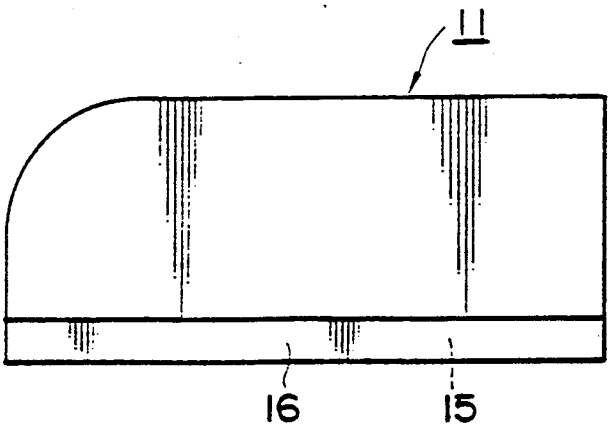
FIG. 4 is a top view of a letter opener according to a first embodiment of the invention.

A sub blade 19 (at the upper or left side in the rightward sliding of the envelope) and a main blade 20 (at the lower or right side) are disposed on the ceiling of the groove 12. These blades 19 and 20 are parallel to the sliding side surface 18 and in series. The blades 19 and 20 are shaped almost like a triangle and each tip 19*a* and 20*a* of the blades juts out toward the cushion 16 or downward. As shown in FIG. 3, a distance H between the blades and the sliding side surface 18 is predetermined (1 mm to 2 mm, for example). The tip 20*a* of the main blade 20 is located approximately in contact with the cushion 16, while the tip 19*a* of the sub blade 19 is higher than the tip 20*a*. The blade edges 19*b* and 20*b* face slantingly-left-downward as shown in FIG. 2.

And next, various advantageous functions of a letter opener constituted as illustrated will be described.

Figure 5:
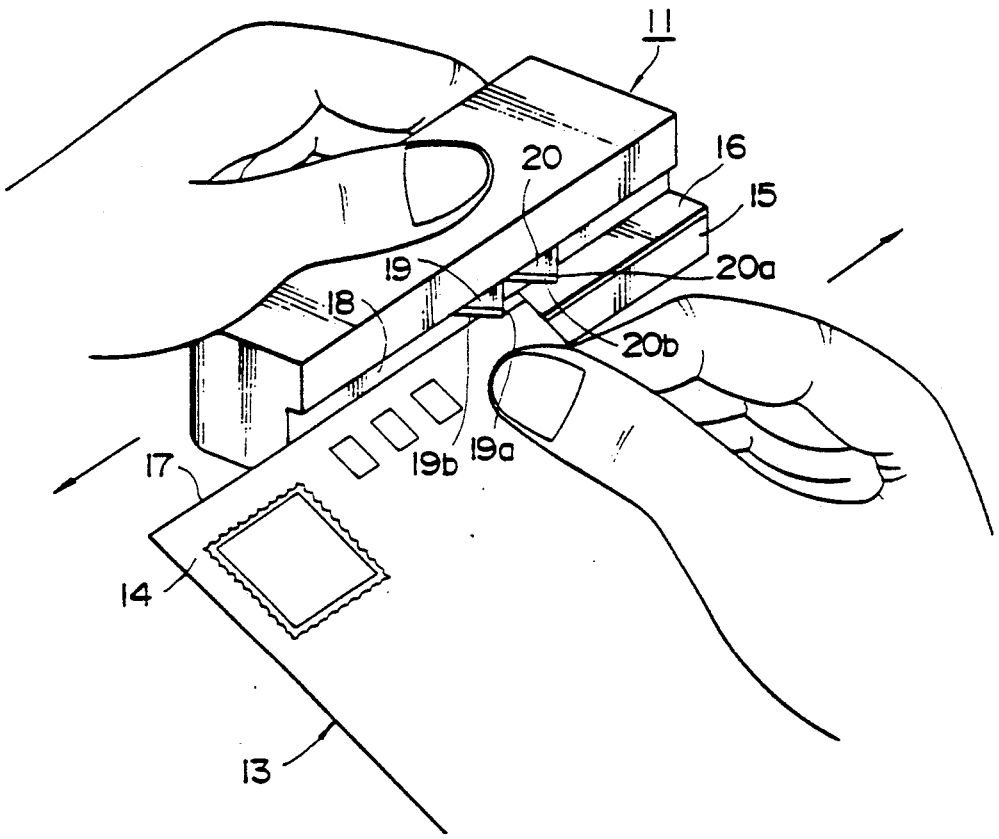
FIG. 5 is a perspective view in use of a letter opener according to a first embodiment of the invention.

In order to open an envelope 13, an edge portion 14 to be opened of the envelope 13 is inserted into the sliding groove 12 and an edge 17 of the portion 14 is contacted with the sliding side surface 18 as shown in FIG. 5. With the edge 17 remaining in contact with the sliding side surface 18, the envelope 13 is slid rightward as shown by the arrow in FIG. 5. The tip 19*a* of the sub blade 19 is first thrust a short distance into the front side of the envelope 13, which has two layers, and then the tip 20*a* of the main blade 20 is thrust deep thereinto, and the front side of the envelope is cut through.

The slantingly-left-downward disposition of the blade edges 19*b* and 20*b* makes it possible to cut firmly, because the edge portion 14 of the envelope 13 is pressed against the cushion 16, not as in the prior art wherein the envelope edge portion 14 remains apart from the sliding surface when cut. In the present embodiment, the blade edges 19*b* and 20*b* facing slantingly-left-downward serve as a press means. As a matter of course, a press member such as a spring may be used as a press means except the blades 19 and 20. Since the press member presses the cushion 16, the edge portion 14 of the envelope moves downward, and accordingly the back side of the envelope is seldom cut through completely.

The thrust of the sub and main blades 19 and 20 into the envelope during the cutting permits the envelope 13 to be cut through in a straight line because the envelope 13 is firmly placed on the surface and the envelope edge 17 is slides in touch with the sliding side surface 18.

Furthermore, since the distance H between the blades and the sliding side surface 18 is predetermined (1 mm to 2 mm, for example), the envelope is opened quickly at a short distance from the envelope edge 17 regardless of the thickness of the envelope.

And furthermore, the disposition of the tip 19*a* of the sub blade 19 located upper (or more distant from the sliding surface) than the tip 20*a* of the main blade 20 permits a gradual cutting, namely the first shallow thrust and cutting by the sub blade 19 and the second deep thrust and cutting by the main blade 20. And accordingly, the envelope 13 can be cut through smoothly and quickly regardless of the thickness of the envelope. In the case of the cutting with the main blade 20 only, it is difficult for the sole blade 20 to cut through the front or back side of the envelope completely because of a strong resistance and separation of the envelope edge from the sliding side surface 18.

And thus, since the front or back side only of the two sides or layers of envelope 13 is cut through, no cut-off scrap is produced to cast away. And the contents of the envelope are easily taken out from the cut slit by holding the edge portion 14 of the envelope with one's hand. It is of course easy to put back the contents thereinto. Even if the cut slit is turned downward, the contents would not fall off because the edge portion 14 of the envelope is not cut off from the envelope itself.

Figure 6:
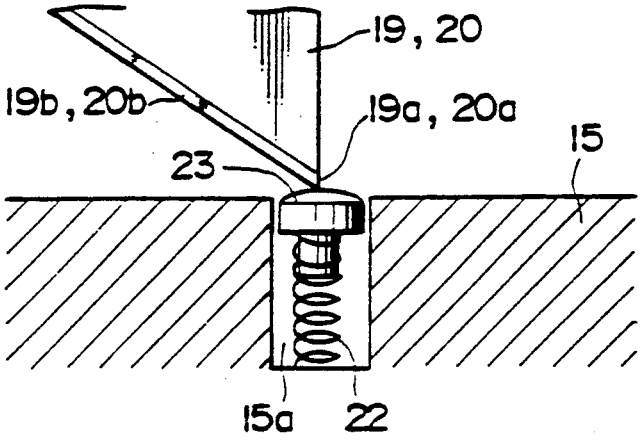
FIG. 6 shows an enlarged partial front sectional view of a letter opener according to a second embodiment of the invention.

FIG. 6 shows a second embodiment according to the invention.

An escape means in the second embodiment is different from that in the first embodiment. A concave portion 15*a* is formed in the sliding floor 15 under the blade tips 19*a* and 20*a* and a pushing-up member 23 with a spring 22 is disposed therein as shown in FIG. 6.

The envelope 13 is pushed downward by the descent of the pushing-up member 23 in connection with the compression of the spring when cut, so that the back side layer of the two layer envelope can not be cut through.

Figure 7:
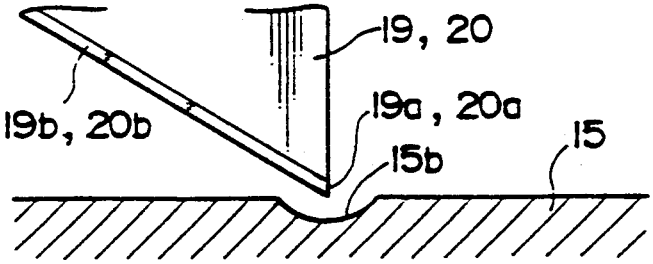
FIG. 7 shows a detail corresponding to FIG. 6 of a letter opener according to a third embodiment of the invention.

FIG. 7 shows a third embodiment according to the invention.

An escape means in the third embodiment is different from those in the first and second embodiments. A concave portion 15*a* as an escape means is formed in the floor 15 under the blade tips 19*a* and 20*a* as shown in FIG. 7.

The envelope 13 moves toward the concave portion 15*b* when cut, so that the back side of the envelope can not be cut through.

In order to overcome the problem of some abrasion of the blade edge owing to the frequent using and to cut through completely, the tips 19*a* and 20*a* can be slightly inserted into the cavity of the concave 15*b*.

Figure 8:
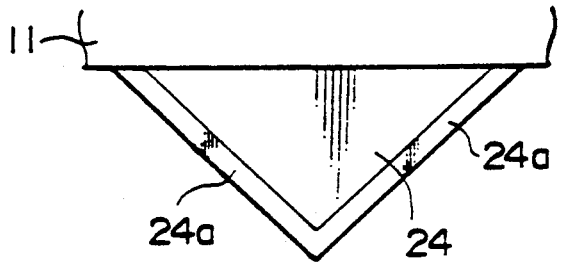
FIG. 8 is a front view of a blade according to a fourth embodiment of the invention.

FIG. 8 shows a fourth embodiment according to the invention.

Referring now to FIG. 8, there is disposed a sole triangle-shaped blade 24 having two blade edges 24*a* and 24*a*. This blade 24 allows to slide and slash the envelope in both the directions in the groove 12, and it is useful for right-handed or the left-handed users.

Figure 9:
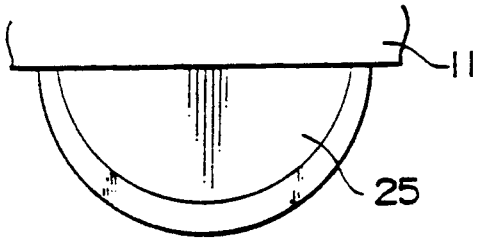
FIG. 9 is a front view of a blade according to a fifth embodiment of the invention.

FIG. 9 shows a fifth embodiment according to the invention.

In this embodiment, there is disposed a half-round-shaped blade 25 by which the envelope 13 can be slided and slashed either rightward or leftward.

Figure 10:
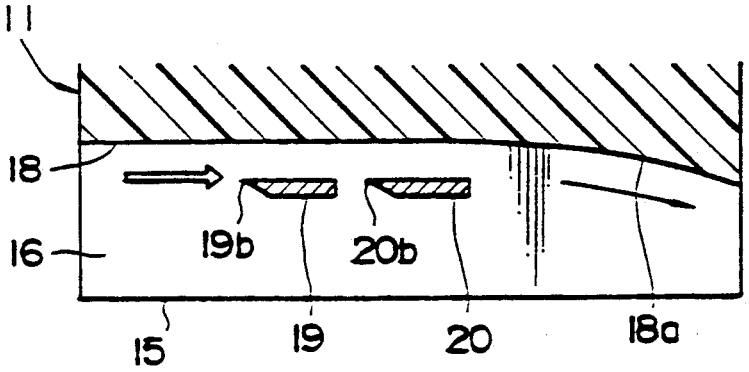
FIG. 10 is a top sectional view of a letter opener according to a sixth embodiment of the invention.
Figure 11:
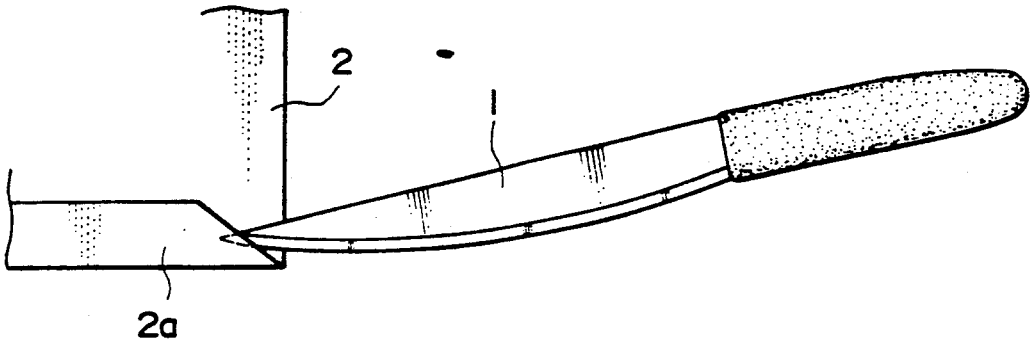
FIG. 11 is a perspective view showing a conventional method for opening an envelope.
Figure 12:
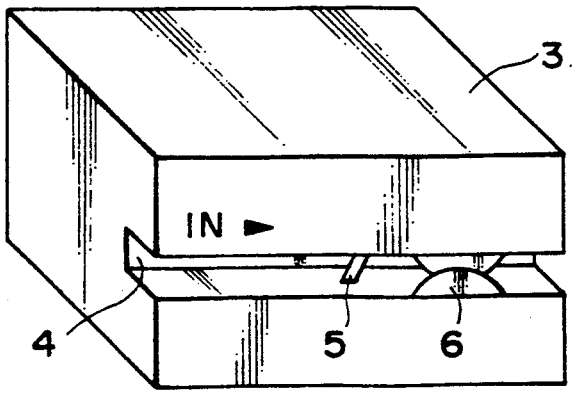
PRIOR ART FIG. 12
FIG. 12 is a perspective view of a conventional letter opener.

FIG. 10 shows a sixth embodiment according to the invention.

In this embodiment, a straight sliding side surface 18 is curved from about the place on the sliding side surface 18 behind the main blade 20.

When the envelope is slided and slashed with the envelope edge 17 remaining in contact with the sliding side surface 18, the envelope edge 17 receives force clockwise centering around the tip 20*b* of the main blade 20 in accordance with the sliding at the curved portion 18*a*. That is, the left side of the envelope edge 17 is pressed against the side 18 and 18*a* for improved sliding. And accordingly, the envelope 13 is cut through always at a given distance from the envelope edge without the separation of the edge 17 from the sliding side 18 and 18*a*.

Each blade 19, 20, 24, and 25 are expendable and can be made to be replacable to be more economical.

Furthermore, the equipment of scales, a measure, or a mirror with the letter opener body 11 makes the application diversified.

Besides the cushion 16 and the concave portion 15*b* shown in the above embodiments, a given gap as an escape means may be formed between the tip 19*a* and the floor 15. This gap ensures that the edge portion to be opened of the envelope 13 is not completely cut off apart from the envelope.

As a matter of course, a cutter of the present invention is not limited to the letter opener in the embodiments mentioned above.

To sum up, a cutter according to the invention, first, can press the edge portion of an article to be cut against the floor and cut it through firmly not as in the prior art wherein the edge portion remains spaced from the floor and unstable to cut.

Second, the provision of an escape means for allowing an article to be cut to move away from the tip of a blade permits the front (or back) side only of a two-layer envelope to be cut in proportion to the thickness of the envelope. And consequently, it produces no cut-off scrap to cast away. The contents of the envelope can be easily taken out from the cut slit by holding the edge side with one's hand. And also it is easy to put it back thereinto in the same way. The contents would not fall out from the cut slit even if it is turned downward because the edge portion is not completely cut off apart from the envelope.

Third, plural blades are disposed in series and the blade tip at the upper (or left) side is located more distant from the sliding floor than that at the down (or right) side, so that the envelope is thrust gradually more deeply and slashed smoothly. Furthermore, plural blades permits the envelope to be guided in a straight line.

Fourth, the formation of the sliding side surface curved from the behind the blade at the down (or right) side produces force for pressing the envelope edge against the sliding side surface so that the envelope can be cut through always at a given distance from the envelope edge.

Fifth, a replaceable blade is more economical.

Sixth, other equipment having various functions in addition to the cutter increases the field of use.

Seventh, a blade with two blade edges or round edge permits the envelope to be cut bidirectionally.

What is claimed is:

1. A cutter for cutting a two-sided article, such as an envelope, at a given distance from an edge of said article approximately straight and parallel to said edge comprising:

a cutter body, a sliding floor formed in said body for receiving a sliding edge portion of said article, a sliding side wall surface disposed approximately perpendicularly to said floor for keeping said edge portion in contact therewith and for sliding said edge thereon, a blade disposed on a ceiling opposite to said floor, said blade disposed parallel to said sliding side wall surface and comprising a lower tip for cutting through said article and for pressing said article against said floor during cutting, and means for cutting through one side of said article by enabling said article to move away from said tip of said blade according to the thickness of said article, wherein a concave portion is formed in said sliding floor beneath said blade tip wherein said blade tip is located at a level substantially the same as that of said sliding floor, the perimeter and shape of said concave portion being adapted for enabling one side of said article to enter said concave portion by a thrust of said tip, whereby said one side is not cut off from the article.

2. A cutter for cutting an article, such as an envelope, at a given distance from an edge of said article approximately straight and parallel to said edge comprising:

a cutter body, a sliding floor formed in said body for receiving a sliding edge portion of said article, a sliding side wall surface disposed approximately perpendicularly to said floor for keeping said edge portion in contact therewith and for sliding said edge thereon, at least one blade disposed on a ceiling opposite to said floor, said blade disposed parallel to said sliding side wall surface and comprising a lower tip for cutting through said article, and for pressing said article against said floor during cutting, wherein said cutter comprises a plurality of blades disposed in series and the blade at the upper side in the sliding direction is more distant from said sliding floor than the blade at the down side in the sliding direction.

3. A cutter according to claim 2, wherein said sliding side surface is curved from about opposite said lower blade in the sliding direction.

* * * * *